US008485805B2

(12) United States Patent
Yong et al.

(10) Patent No.: US 8,485,805 B2
(45) Date of Patent: Jul. 16, 2013

(54) ROTARY COMPRESSOR

(75) Inventors: Minchul Yong, Seoul (KR); Yunhi Lee, Seoul (KR); Yoonsung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 12/961,665

(22) Filed: Dec. 7, 2010

(65) Prior Publication Data

US 2011/0135526 A1 Jun. 9, 2011

(30) Foreign Application Priority Data

Dec. 7, 2009 (KR) ..... 10-2009-0120792

(51) Int. Cl.
*F01C 23/00* (2006.01)
*F01C 21/10* (2006.01)

(52) U.S. Cl.
USPC ..... 418/212; 418/150

(58) Field of Classification Search
USPC ..... 418/150, 11, 60, 212, 63
See application file for complete search history.

(56) References Cited

U.S. PATENT DOCUMENTS

2003/0068236 A1* 4/2003 Tadano et al. ..... 417/312
2008/0056913 A1* 3/2008 Byun et al. ..... 417/303

FOREIGN PATENT DOCUMENTS

CN 1451864 A 10/2003
CN 1991178 A 7/2007
CN 101052808 A 10/2007
CN 101086255 A 12/2007
JP 2007-170407 7/2007

OTHER PUBLICATIONS

Chinese Office Action issued in CN Application No. 201010583516.5 dated Mar. 4, 2013.

* cited by examiner

*Primary Examiner* — Thomas Denion
*Assistant Examiner* — Laert Dounis
(74) *Attorney, Agent, or Firm* — KED & Associates, LLP

(57) ABSTRACT

A rotary compressor is provided. A suction hole is formed through a middle plate of the compressor to distribute refrigerant into both upper and lower cylinders. Coupling bolts having an appropriate length couple the cylinders to the middle plate. The length of the coupling bolts may be defined such that deformation of vane slots of the cylinders due to coupling of the cylinders may be minimized or eliminated, and friction loss and leakage loss between the vane and the vane slot may be reduced, thus improving compressor function.

14 Claims, 6 Drawing Sheets

$$W_{min}=W+W_{1,min}-W_{1,max}$$

ROTARY COMPRESSOR

CROSS-REFERENCE TO RELATED APPLICATION(S)

This application claims priority under 35 U.S.C. §119 to Korean Application No. 10-2009-0120792, filed in Korea on Dec. 7, 2009, whose entire disclosure is hereby incorporated by reference.

BACKGROUND

1. Field

This relates to a compressor, and in particular, to a rotary compressor capable of supplying refrigerant to a plurality of compression spaces through a single suction passage.

2. Background

In general, refrigerant compressors are used in refrigerators or air conditioners using a vapor compression refrigeration cycle (hereinafter, referred to as 'refrigeration cycle'). A constant speed type compressor may be driven at a substantially constant speed, while an inverter type compressor may be operated at selectively controlled rotational speeds.

A refrigerant compressor in which a driving motor and a compression device operated by the driving motor are installed in an inner space of a hermetic casing is called a hermetic compressor, and may be used in various home and/or commercial applications. A refrigerant compressor in which the driving motor is separately installed outside the casing is called an open compressor. Refrigerant compressors may be further classified into a reciprocal type, a scroll type, a rotary type and others based on a mechanism employed for compressing a refrigerant.

The rotary compressor may employ a rolling piston which is eccentrically rotated in a compression space of a cylinder, and a vane, which partitions the compression space of the cylinder into a suction chamber and a discharge chamber. Such a compressor may benefit from an enhanced capacity or a variable capacity.

BRIEF DESCRIPTION OF THE DRAWINGS

The embodiments will be described in detail with reference to the following drawings in which like reference numerals refer to like elements wherein.

DETAILED DESCRIPTION

A twin rotary compressor may include a plurality of cylinders that may be selectively operated to provide increased and or variable capacity. Such a twin rotary compressor may employ an independent suction mechanism, in which suction pipes are respectively connected to the cylinders, or an integrated suction mechanism, in which a common suction pipe is connected to one of the two cylinders, or a common suction pipe is connected to a middle plate, which is disposed between the cylinders to partition the compression space. A plurality of coupling bolts may couple, at both sides in an axial direction, the cylinders, the middle plate between the cylinders and a plurality of bearings that cover the cylinders to form each compression space.

However, as the coupling bolts are typically coupled to one of the cylinders, cylinder deformation may occur during coupling. This deformation may cause unstable behavior of the vane, which is inserted in the cylinder to reciprocate in the cylinder, thereby lowering a compression capacity. That is, when the coupling bolts are coupled to one of the cylinders through the bearings and the middle plate, the cylinder may be deformed due to a clamping force generated upon coupling of the coupling bolts, which may cause a vane slot in the vane to be twisted or otherwise deformed, increasing friction between the vane and the vane slot or bending of the vane, and lowering of a sealing force with a rolling piston, thereby deteriorating the compression capacity of the compressor.

Figure 1:
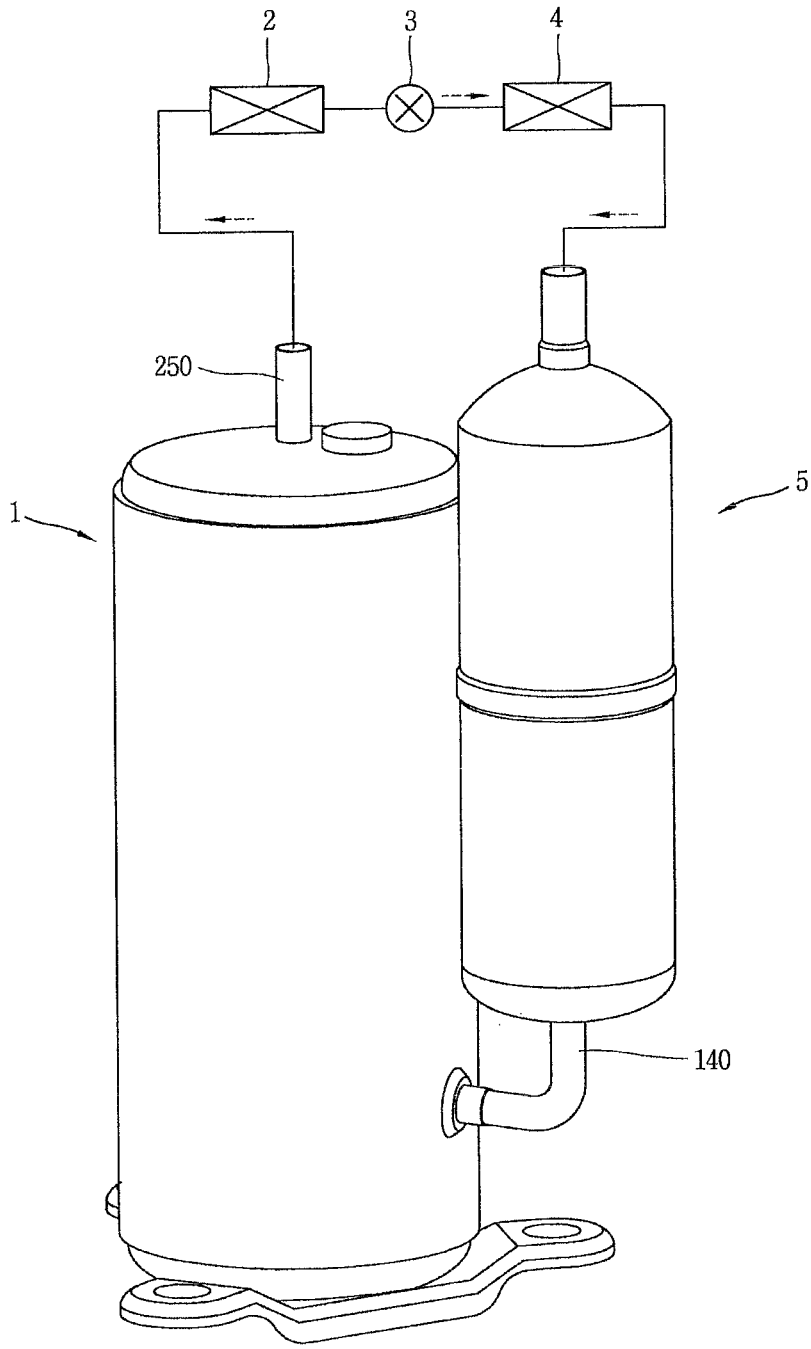
FIG. 1 is a schematic view of a refrigeration cycle including a rotary compressor.

As shown in FIG. 1, a rotary compressor 1 according to one exemplary embodiment may have a suction side thereof connected to an outlet side of an evaporator 4 and simultaneously have a discharge side thereof connected to a suction side of a condenser 2 so as to form a part of a closed loop refrigeration cycle which sequentially connects the condenser 2, an expansion apparatus 3 and the evaporator 4. An accumulator 5 is positioned between the outlet side of the evaporator 4 and the suction side of the compressor 1 to separate refrigerant from the evaporator 4 into gas refrigerant and liquid refrigerant.

Figure 2:
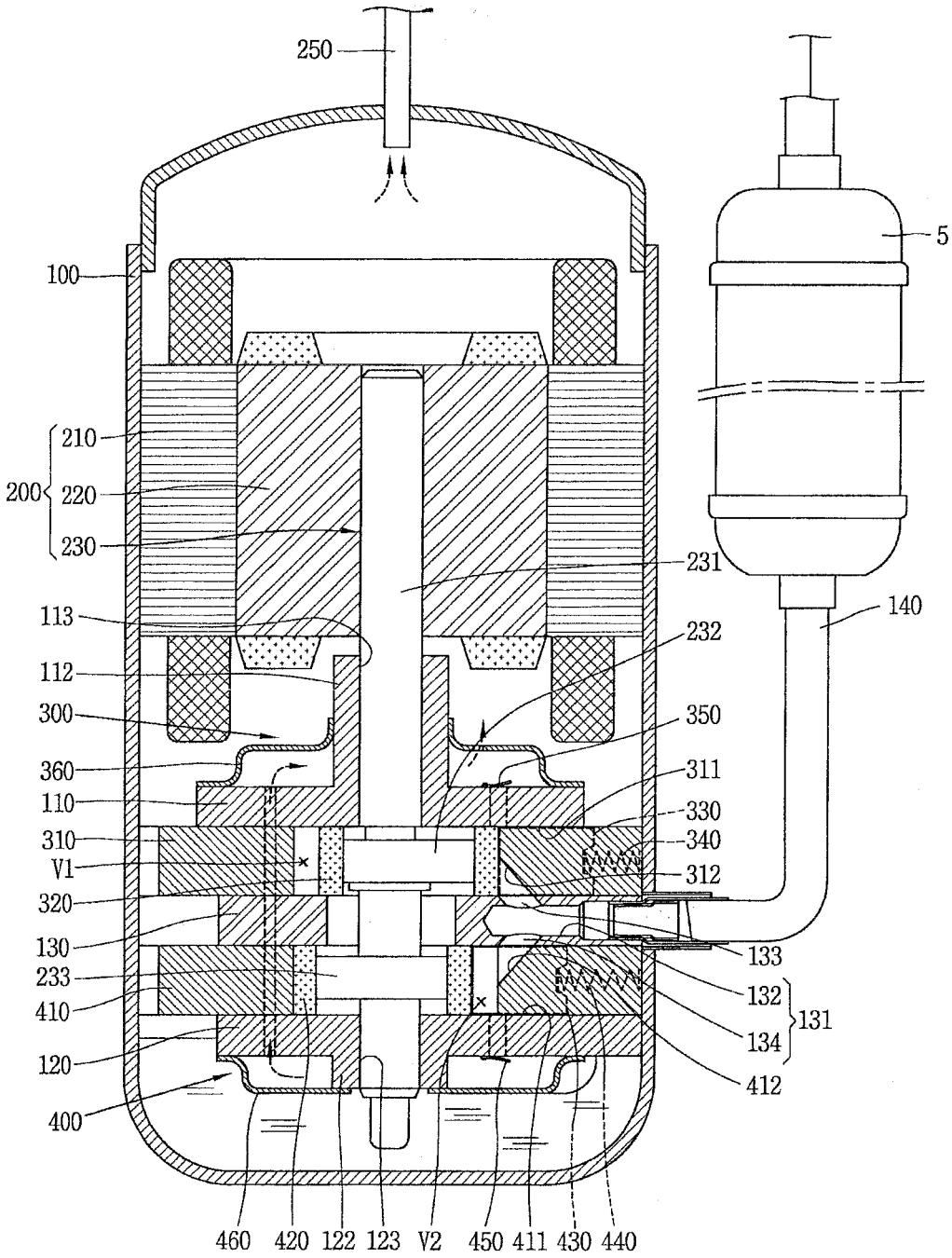
FIG. 2 is a longitudinal sectional view of an inside of the rotary compressor shown in FIG. 1.

The compressor 1, as shown in FIG. 2, may include a motor 200 provided at an upper portion of an inner space of a hermetic casing 100 to generate a driving force, and first and second compression devices 300 and 400 provided at a lower portion of the inner space of the casing 100 to compress a refrigerant using the driving force generated by the motor 200.

The inner space of the casing 100 is maintained in a discharge pressure state by a refrigerant discharged from both the first and second compression devices 300 and 400 or from the first compression device 300. A gas suction pipe 140 that allows refrigerant to be drawn in between the first and second compression devices 300 and 400 may be connected to a lower portion of the casing 100, and a gas discharge pipe 250 that allows compressed refrigerant to be discharged into a refrigeration system may be connected to an upper end of the casing 100. The gas suction pipe 140 may be inserted in a middle connection pipe, which is inserted in a suction passage 131 of a middle plate 130, and in certain embodiments, may be welded to the middle connection pipe.

The motor 200 may include a stator 210 secured to an inner circumferential surface of the casing 100, a rotor 220 rotatably disposed within the stator 210, and a crank shaft 230 shrink-fitted to the rotor 220 so as to be rotatable with the rotor 220. The motor 200 may be a constant speed motor, an inverter motor, or other type of motor as appropriate. In consideration of fabricating cost, the motor 200 may be a constant speed motor so as to idle one of the first or second compression devices 300 and 400, when necessary, so as to switch an operational mode of the compressor.

The crank shaft 230 may include a shaft portion 231 coupled to the rotor 220, and first and second eccentric portions 232 and 233 formed at a lower portion of the shaft portion 231 so as to be eccentric to both right and left sides of the shaft portion 231. The first and second eccentric portions 232 and 233 may be symmetrically formed by a phase difference of about 180° therebetween. First and second rolling pistons 320 and 420, which will be described later, may be rotatably coupled to the first and second eccentric portions 232 and 233, respectively.

The first compression device 300 may include a first cylinder 310 having an annular shape and installed within the casing 100, the first rolling piston 320 rotatably coupled to the first eccentric portion 232 of the crank shaft 230 to compress a refrigerant as it orbits in a first compression space V1 of the first cylinder 310, a first vane 330 movably coupled to the first cylinder 310 in a radial direction such that a sealing surface of one end thereof contacts an outer circumferential surface of the first rolling piston 320 so as to partition the first compression space V1 of the first cylinder 310 into a first suction chamber and a first discharge chamber, and a vane spring 340 implemented as, for example, a compression spring, so as to elastically support a rear end of the first vane 330.

The second compression device 400 may include a second cylinder 410 having an annular shape and installed below the first cylinder 310 within the casing 100, the second rolling piston 420 rotatably coupled to the second eccentric portion 233 of the crank shaft 230 to compress a refrigerant as it orbits in a second compression chamber V2 of the second cylinder 410, a second vane 430 movably coupled to the second cylinder 410 in a radial direction and contacting an outer circumferential surface of the second rolling piston 420 so as to partition the second compression space V2 of the second cylinder 410 into a second suction chamber and a second discharge chamber or separated from the outer circumferential surface of the second rolling piston 420 to provide for communication between the second suction chamber and the second discharge chamber, and a vane spring 440 implemented as, for example, a compression spring, to elastically support a rear end of the second vane 430.

The first cylinder 310 and the second cylinder 410 may respectively include a first vane slot 311 and a second vane slot 411 formed at respective inner circumferential surfaces of the first and second compression spaces V1 and V2 to allow a linear reciprocation of the first and second vanes 330 and 430, and a first suction port 312 (suction groove, suction groove, suction slit, etc.) and a second suction port 412 formed at respective sides of the first and second vane slots 311 and 411 to induce a refrigerant into the first and second compression spaces V1 and V2.

The first suction port 312 and the second suction port 412 may be formed with an inclination angle by chamfering a lower surface edge of the first cylinder 310 and an upper surface edge of the second cylinder 410, respectively, which come in contact with upper and lower ends of divergent holes 133 and 134 of a middle plate 130 to be explained later, respectively, so as to be inclined toward the first cylinder 310 and the second cylinder 410.

An upper bearing plate (hereinafter, referred to as 'upper bearing') 110 may cover a top of the first cylinder 310, and a lower bearing plate (hereinafter, referred to as 'lower bearing') 120 may cover a lower side of the second cylinder 410. The middle plate 130, which forms the first and second compression spaces V1 and V2 together with the both bearings 110 and 120, may be installed between a lower side of the first cylinder 310 and an upper side of the second cylinder 410.

The upper bearing 110 and the lower bearing 120 may have a disc-like shape. A first bearing portion 112 and a second bearing portion 122 having shaft holes 113 and 123, respectively, may protrude from centers of the upper bearing 110 and the lower bearing 120 so as to support the shaft portion 231 of the crank shaft 230 in a radial direction.

The middle plate 130 may have an annular shape with an inner diameter as wide as the eccentric portions 232 and 233 of the crank shaft 230 being inserted therethrough. One side of the middle plate 130 has the suction passage 131 formed therein for allowing the gas suction pipe 140 to communicate with the first suction port 312 and the second suction port 412, which will be explained later. The suction passage 131 may include a suction hole 132 communicating with the gas suction pipe 140, and the first and second divergent holes 133 and 134 for allowing the first and second suction ports 312 and 412 to communicate with the suction hole 132.

The suction hole 132 may have a predetermined depth from the outer circumferential surface of the middle plate 130 in a radial direction.

The first and second divergent holes 133 and 134 may be inclined by a predetermined angle, for example, an angle in the range of 0° to 90° based upon a central line of the suction hole 132. In certain embodiments, an angle in the range of 30° to 60°, from an inner end of the suction hole 132 toward the first and second suction ports 312 and 412, may be appropriate.

The compressor 1 may also include a first discharge valve 350, a first muffler 360, a second discharge valve 450 and a second muffler 460.

Hereinafter, a description of a process of compressing a refrigerant in each compression space in a rotary compressor as embodied and broadly described herein will be provided.

If power is supplied to the motor 200 to rotate the rotor 220, the crank shaft 230 rotates together with the rotor 220 to transfer a rotating force of the motor 200 to the first and second compression devices 300 and 400. The first and second rolling pistons 320 and 420 within the first compression device 300 and the second compression device 400 eccentrically rotate in the first compression space V1 and the second compression space V2, respectively. The first vane 330 and the second vane 430 thus compress a refrigerant while forming the compression spaces V1 and V2, having a phase difference of approximately 180° therebetween, together with the first and second rolling pistons 320 and 420.

For example, if a suction process is initiated in the first compression space V1, refrigerant is introduced into the suction passage 131 of the middle plate 130 through the accumulator 5 and the suction pipe 140. The refrigerant then flows into the first compression space V1 via the first suction port 312 of the first cylinder 310 so as to be compressed therein.

During a compression process in the first compression space V1, a suction process is initiated in the second compression space V2 of the second cylinder 410 having a phase difference of approximately 180° from the first compression space V1. Accordingly, the second suction port 412 of the second cylinder 410 communicates with the suction passage 131, so that refrigerant is drawn into the second compression space V2 via the second suction port 412 of the second cylinder 410 so as to be compressed therein.

The first vane 330 and the second vane 430 may be slidably coupled to the first vane slot 311 and the second vane slot 411 so as to radially reciprocate in response to an orbiting motion of the first and second rolling pistons 320 and 420, thereby partitioning each of the first compression space V1 and the second compression space V2 into a suction chamber and a discharge chamber.

However, if the first and second cylinders 310 and 410 were deformed upon assembly of the first and second compression devices 300 and 400 as described above, the vane slots 311 and 411 could be twisted or an interval between the wall surfaces thereof may become non-uniform so as to present an obstacle to the vanes 330 and 430 intended to reciprocate along a straight line. Consequently, friction may be generated between the vanes 330 and 430 and the vane slots 311 and 411 or a gap (clearance) may be generated therebetween, thereby causing leakage of refrigerant. Hence, obviating the deformation of the cylinders 310 and 410 upon assembly of the compression devices 300 and 400 may improve compressor efficiency and capacity.

In order to obviate twisting of the cylinders due to, for example, a clamping force of coupling bolts, the middle plate 130 and the cylinders 310 and 410 may be coupled while simultaneously limiting a length, namely, a clamping length, of the coupling bolts.

Figure 3:
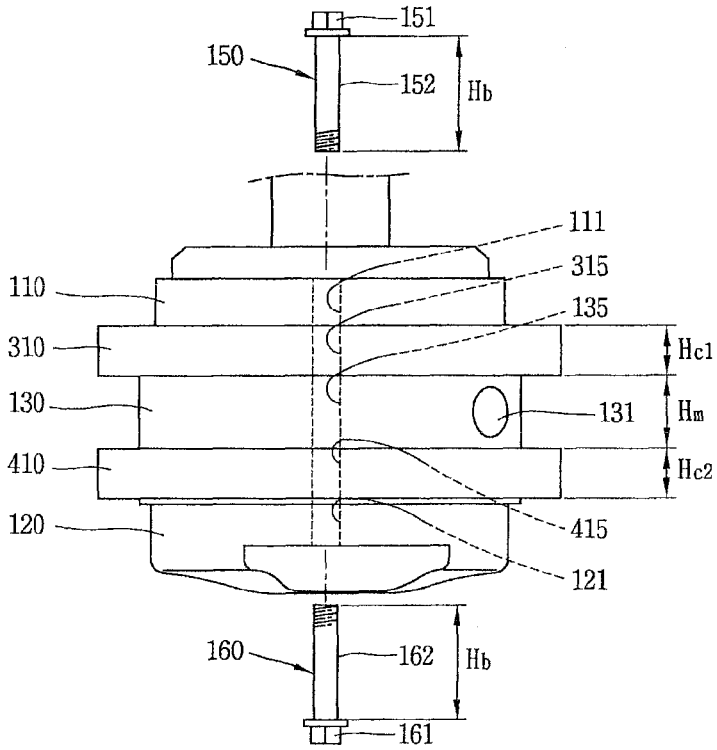
FIG. 3 is a front view of a coupled state of compression devices shown in FIG. 2.
Figure 4:
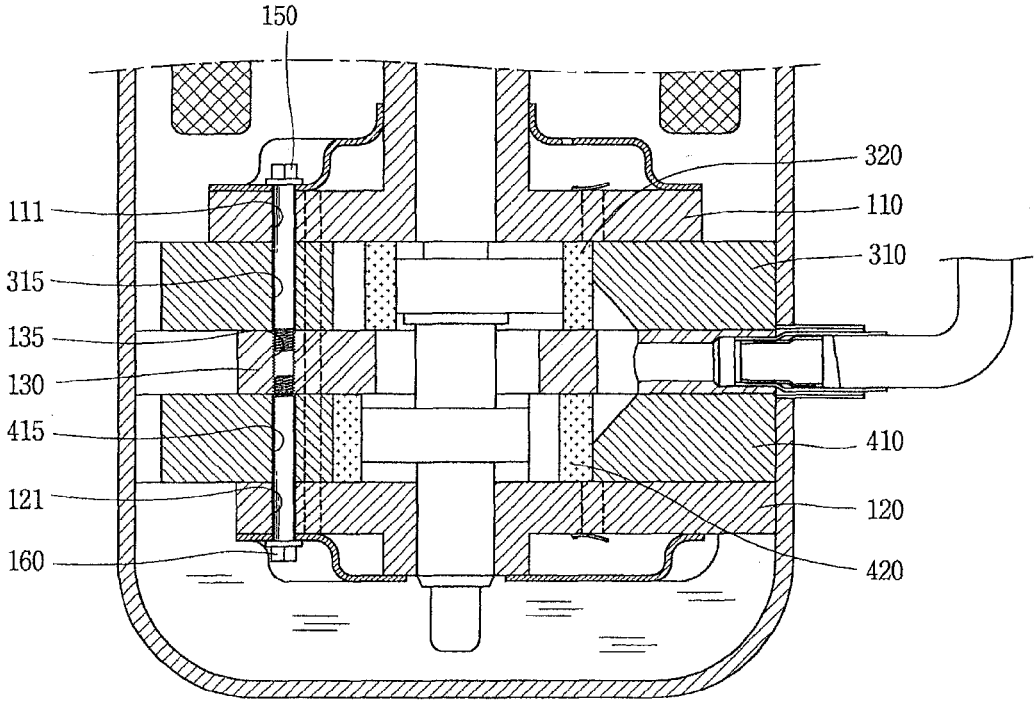
FIG. 4 is a longitudinal sectional view of the coupled state of the compression devices shown in FIG. 2.

To this end, as shown in FIGS. 3 and 4, the coupling bolts may include a first coupling holt 150 for coupling the upper bearing 110 and the first compression device 300 to the middle plate 130, and a second coupling bolt 160 for coupling the lower bearing 120 and the second compression device 400 to the middle plate 130.

For example, the upper bearing 110 and the first cylinder 310 may include a plurality of through holes 111 and 315, respectively, formed in a circumferential direction to concentrically match each other in an axial direction. Accordingly, the first coupling bolt 150 may be inserted through the plurality of through holes 111 and 315 of the upper bearing 110 and the first cylinder 310 so as to be coupled to the upper side of the middle plate 130. Also, the lower bearing 120 and the second cylinder 410 may include a plurality of through holes 121 and 415, respectively, formed in a circumferential direction to concentrically match each other in an axial direction. Accordingly, the second coupling bolt 160 may be inserted through the plurality of through holes 121 and 415 of the lower bearing 120 and the second cylinder 410 so as to be coupled to the lower side of the middle plate 130. Also, the middle plate 130 may be provided with a plurality of coupling holes 135 formed in a circumferential direction at predetermined intervals such that the through holes 111 and 315 can concentrically match with the through holes 121 and 415.

The first and second coupling bolts 150 and 160 may respectively include bolt head portions 151 and 161, and coupling portions 152 and 162 extending from the bolt head portions 151 and 161 to be coupled to the coupling hole 135 through the through holes 111, 315 and 121, 415. The maximum lengths of the coupling portions 152 and 162 of the coupling bolts 150 and 160 may be established using the following formula so as to reduce deformation of the cylinders 310 and 410. That is, a bolt length $H_b$ of each coupling bolt 150, 160 may be established according to Formula 1, as follows, in proportion to thicknesses $H_{c1}$ and $H_{c2}$ of the cylinders 310 and 410 and the thickness $H_m$ of the middle plate 130.

$$A\frac{H_{c1}+H_{c2}}{H_m} < H_b < B\frac{H_{c1}+H_{c2}}{H_m} \qquad \text{Formula 1}$$

In Formula 1 above, a variable A may be in the range of 15<A<20, and in certain embodiments, 17.93, and a variable B may be in the range of 25<B<30, and in certain embodiments, 27.91.

In addition, in view of lengths $H_b$ of the coupling portions 152 and 162 of the coupling bolts 150 and 160, lengths coupled at two opposite sides of the middle plate 130 in a thickness direction may be substantially the same such that depths coupled into the middle plate 130 may also be substantially the same, so as to reduce/eliminate deformation of the cylinders 310 and 410.

In certain embodiments, the total coupling depth of the coupling bolts 150 and 160 coupled to two opposite sides of the middle plate 130 in the thickness direction may be less than two thirds of the thickness of the middle plate 130 to reduce/eliminate deformation of the cylinders 310 and 410.

Figure 5:
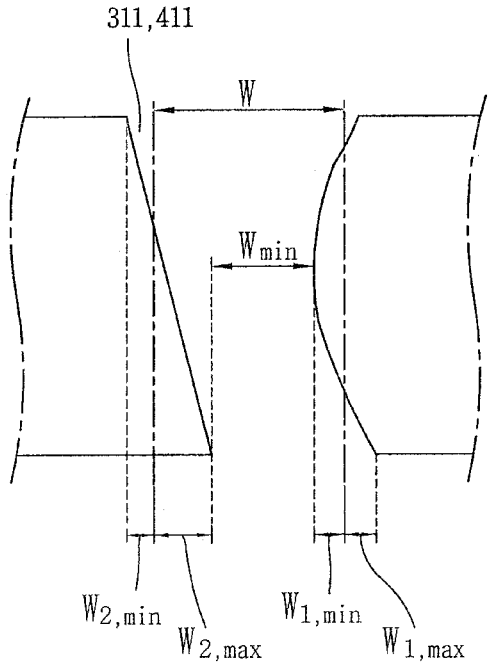
FIG. 5 is a schematic view of a deformed vane slot.
Figure 6A:
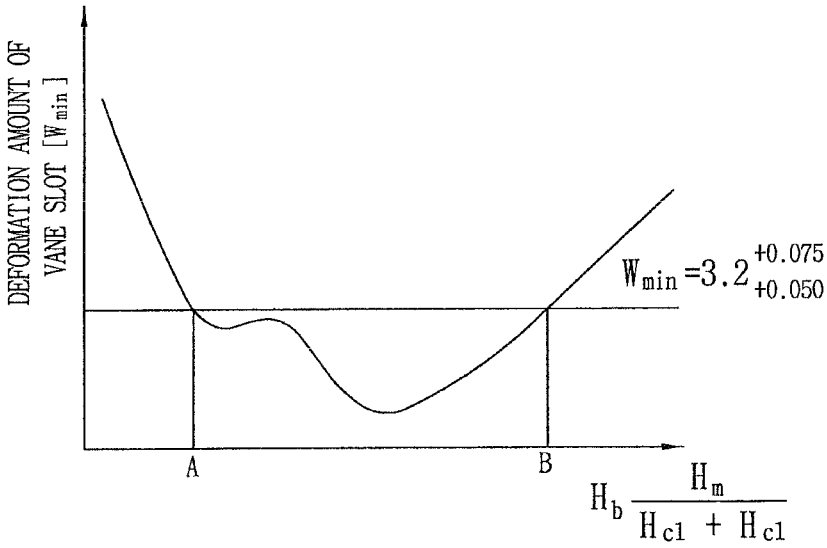
FIGS. 6A and 6B are graphs of a deformation amount of a vane slot.
Figure 6B:
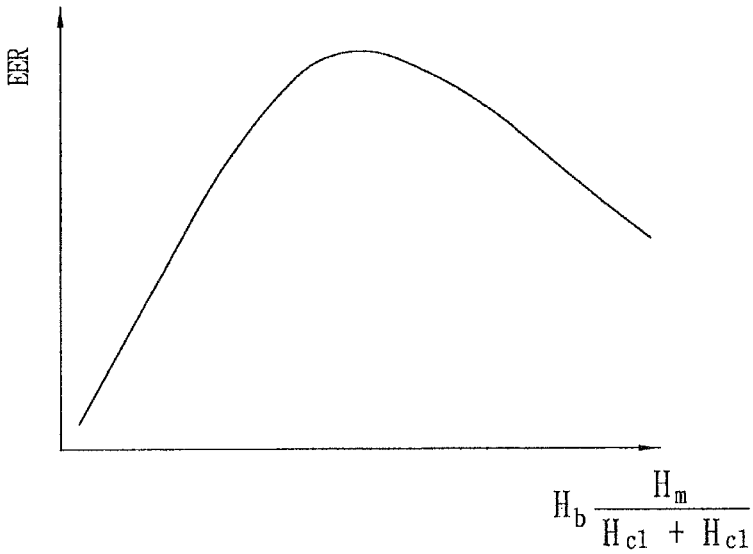

FIG. 5 is a schematic view of a deformed state of one of the vane slots 311, 411, and FIGS. 6A and 6B are graphs comparing a deformation amount of the vane slots 311, 411, to which a component ratio according to the above mentioned Formula 1 is applied, and the corresponding energy efficiency.

FIGS. 5, 6A and 6B show that when a length C of a coupling device, where $C=H_b\times H_m/(H_{c1}+H_{c2})$, required to satisfy a minimum interval $W_{min}$, where $W_{min}$=3.2 (+0.075, −0.050), between two opposite wall surfaces of the vane slots 311 and 411 to allow for reciprocation of the vanes 330 and 430 is in the range of about A<C<B, the highest energy efficiency EER is exhibited. In FIG. 5, W is an interval between the two opposite walls of the vane slots 311, 411 before any deformation, $W_{1min}$ is a minimum deformation interval of the right wall of the vane slot, $W_{2min}$ is a minimum deformation interval of the left wall of the vane slot, $W_{1max}$ is a maximum deformation interval of the right wall of the vane slot and $W_{2max}$ is a maximum deformation interval of the left wall of the vane slot.

That is, when the length C of the coupling device is less than the variable A, energy efficiency is lowered drastically. On the contrary, when the length C of the coupling device is greater than the variable B, energy efficiency is relatively gradually lowered as compared to the previous case.

Therefore, when the length C of the coupling device is greater than the variable A and less than the variable B, high energy efficiency may be obtained, indicating that cylinder deformation may be minimized/eliminated and friction loss of the vane and leakage loss between the vane and the rolling piston may be most efficiently reduced.

Consequently, a rotary compressor as described above may obviate the deformation of the vane slots of the cylinders during coupling of the cylinders, and friction loss of the vane and leakage loss between the vane and the vane slot may be resulting in improvement of the compressor function.

Hereinafter, a rotary compressor in accordance with another embodiment as broadly described herein will be discussed.

Figure 7:
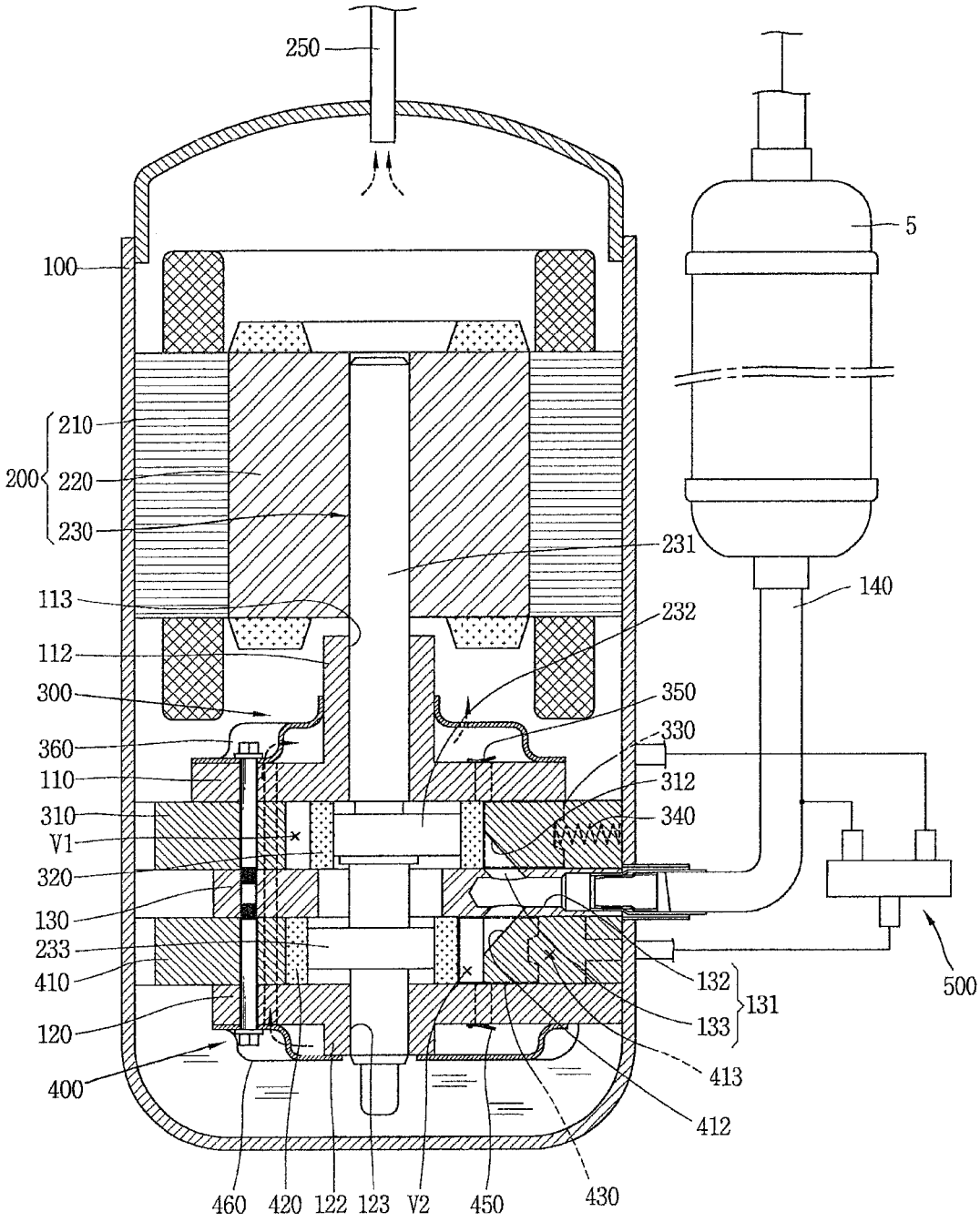
FIG. 7 is a longitudinal sectional view of a capacity-variable type rotary compressor in accordance with embodiments as broadly described herein.

In the embodiment shown in FIGS. 2-5, the first vane 330 and the second vane 430 contact the rolling pistons 320 and 420, respectively upon being pressed. However, the exemplary embodiment shown in FIG. 7 illustrates a capacity-variable rotary compressor in which a vane chamber 413 isolated from the inner space of the casing 100 is formed at a rear end of the second vane 430 of the second compression device 400, a mode switching device 500 for selectively supplying suction pressure or discharge pressure is connected to the vane chamber 413, and a restricting device for selectively restricting the movement of the vane 430 using a pressure differential is disposed at a side surface of the vane 430. Similar to the previous embodiment, the coupling bolts 150 and 160 are coupled to the middle plate 130 and the length of the coupling portion 152, 162 of the coupling bolt 150, 160 is defined according to the previously mentioned Formula 1. The operational effects may be understood by the foregoing description, and thus further detailed description will be omitted.

A rotary compressor as embodied and broadly described herein may be formed such that the suction hole is formed through the middle plate to distribute a refrigerant into both cylinders and an appropriate size (length) of the coupling bolts for coupling the cylinders to the middle plate may be defined, whereby deformation of the vane slots of the cylinders, which may occur during coupling of the cylinders, may be minimized/eliminated, and friction loss of the vane and leakage loss between the vane and the vane slot may be reduced, resulting in improvement of compressor function.

A rotary compressor according to embodiments as broadly described herein may widely be applicable to refrigeration systems, such as home or commercial air conditioners, and the like.

A rotary compressor is provided that is capable of stabilizing the behavior of a vane by reducing deformation of a cylinder, which may occur upon coupling the cylinder and bearing, and accordingly improving a compression function of the compressor.

A rotary compressor as embodied and broadly described herein may include a plurality of cylinders each having a compression space and having a rolling piston and a vane for compressing a refrigerant in the compression space, a middle plate installed between the cylinders to partition each compression space, and having one suction passage for allowing a refrigerant to be distributed into the compression spaces, a plurality of bearings each configured to cover an outer surface of each cylinder to form the compression space in each cylinder together with the middle plate, and a plurality of coupling bolts inserted through the bearings and the cylinders to be coupled to both side surfaces of the middle plate, wherein the coupling bolt has a bolt length Hb defined by the following Formula in proportion to thicknesses Hc1 and Hc2 of the cylinders and a thickness of the middle plate, $$A\frac{H_{c1}+H_{c2}}{H_m} < H_b < B\frac{H_{c1}+H_{c2}}{H_m}$$

The variable A may be in the range of 15<A<20, and the variable B may be in the range of 25<B<30.

A rotary compressor in accordance with another embodiment as broadly described herein may include a plurality of cylinders each having a compression space and having a rolling piston and a vane for compressing a refrigerant in the compression space, a middle plate installed between the cylinders to partition each compression space, and having one suction passage for allowing a refrigerant to be distributed into the compression spaces, a plurality of bearings each configured to cover an outer surface of each cylinder to form the compression space in each cylinder together with the middle plate, and a plurality of coupling bolts inserted through the bearings and the cylinders to be coupled to both side surfaces of the middle plate, wherein bolt lengths of the coupling bolts coupled to both sides of the middle plate in the thickness direction are the same as each other.

A rotary compressor in accordance with another embodiment as broadly described herein may include a plurality of cylinders each having a compression space and having a rolling piston and a vane for compressing a refrigerant in the compression space, a middle plate installed between the cylinders to partition each compression space, and having one suction passage for allowing a refrigerant to be distributed into the compression spaces, a plurality of bearings each configured to cover an outer surface of each cylinder to form a compression space in each cylinder together with the middle plate, and a plurality of coupling bolts inserted through the bearings and the cylinders to be coupled to both side surfaces of the middle plate, wherein depths by which the coupling bolts are coupled to both sides of the middle plate in the thickness direction are the same as each other.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a plurality of cylinders, each of the plurality of cylinders comprising a compression space, a rolling piston and a vane for compressing refrigerant in the compression space;

a middle plate installed between two adjacent cylinders of the plurality of cylinders;

a plurality of bearings each configured to cover an outer surface of a respective cylinder so as to define the compression space of each cylinder together with the middle plate; and a plurality of coupling bolts inserted through the plurality of beatings and the plurality of cylinders so as to be respectively coupled to two opposite sides of the middle plate, wherein a length $H_b$ of each coupling bolt is proportional to thicknesses $H_{c1}$ and $H_{c2}$ of the plurality of cylinders and a thickness $H_m$ of the middle plate, and wherein the length $H_b$ of each coupling bolt is proportional to the thicknesses $H_{c1}$ and $H_{c2}$ of the cylinders and the thickness $H_m$ of the middle plate in accordance with the formula $$A\frac{H_{c1}+H_{c2}}{H_m} < H_b < B\frac{H_{c1}+H_{c2}}{H_m},$$

where variable A is in the range of 15<A<20, and variable B is in the range of 25<B<30.

2. The rotary compressor of claim 1, wherein the lengths of the coupling bolts respectively coupled to the two opposite sides of the middle plate in the thickness direction are the same.

3. The rotary compressor of claim 1, wherein depths by which the coupling bolts are respectively coupled to the two opposite sides of the middle are the same.

4. The rotary compressor of claim 1, wherein a total coupling depth of the coupling bolts coupled to the two opposite sides of the middle plate is less than the thickness of the middle plate.

5. The rotary compressor of claim 1, wherein each of the plurality of cylinders comprises a suction port, and the middle plate comprises a suction passage, wherein the suction passage is in communication with the suction ports of the plurality of cylinders so as to guide refrigerant into the compression spaces formed in the plurality of cylinders.

6. The rotary compressor of claim 5, wherein the suction passage comprises:

a suction hole formed in a radial direction in the middle plate so as to communicate with a gas suction pipe; and a plurality of divergent holes that each diverge from an end of the suction hole and each extend toward one of the plurality of cylinders so as to respectively communicate with the suction ports of the plurality of cylinders.

7. The rotary compressor of claim 6, wherein each of the plurality of divergent holes is formed so as to be flush with a respective suction port.

8. The rotary compressor of claim 1, wherein at least one of the plurality of cylinders comprises a vane chamber that is isolated from an inner space of a casing, wherein a mode switching device is connected to the vane chamber so as to selectively supply discharge pressure or suction pressure to the vane chamber based on an operational mode of the compressor such that the vane presses against the rolling piston or is separated from the rolling piston.

9. A rotary compressor, comprising:

first and second cylinders having first and second compression spaces respectively formed therein, with first and second rolling pistons and first and second vanes respectively provided in the first and second compression spaces;

a middle plate installed between the first and second cylinders to partition the first and second compression spaces, the middle plate having a suction passage formed therein that guides refrigerant into the first and second compression spaces;

first and second bearings that respectively cover an outer surface of the first and second cylinders opposite the middle plate so as to define the first and second compression spaces together with the middle plate; and a plurality of first and second coupling bolts respectively inserted through the first and second bearings and the first and second cylinders so as to be respectively coupled to first and second sides of the middle plate, wherein lengths of the plurality of first and second coupling bolts are the same, and wherein each of the plurality of first and second coupling bolts has a length $H_b$ that is proportional to a thickness $H_{c1}$ of the first cylinder and a thickness $H_{c2}$ of the second cylinder and a thickness $H_m$ of the middle plate in accordance with the formula $$A\frac{H_{c1}+H_{c2}}{H_m} < H_b < B\frac{H_{c1}+H_{c2}}{H_m},$$

where variable A is in the range of 15<A<20, and variable B is in the range of 25<B<30.

10. The rotary compressor of claim 9, wherein a total coupling depth of each first coupling bolt and a corresponding second coupling bolt respectively coupled to the first and second opposite sides of the middle plate is less than a thickness of the middle plate.

11. The rotary compressor of claim 9, wherein the suction passage comprises:

a suction hole formed in the middle plate in a radial direction so as to communicate with a gas suction pipe; and first and second divergent holes that diverge from an end of the suction hole toward the first and second cylinders so as to respectively communicate with the suction ports of the first and second cylinders, wherein the first and second divergent holes are inclined with respect to a center line of the suction hole.

12. A rotary compressor, comprising:

first and second cylinders having first and second compression spaces respectively formed therein, with first and second rolling pistons and first and second vanes respectively provided in the first and second compression spaces;

a middle plate installed between the first and second cylinders to partition the first and second compression spaces, the middle plate having a suction passage formed therein that guides refrigerant into the first and second compression spaces;

first and second bearings that respectively cover first and second outer sides of the first and second cylinders opposite the middle plate so as to define the first and second compression spaces together with the middle plate; and a plurality of first coupling bolts and a corresponding plurality of second coupling bolts respectively inserted through the first and second bearings and the first and second cylinders and respectively coupled to the first and second outer sides of the middle plate, wherein depths by which the plurality of first coupling bolts and plurality of second coupling bolts are respectively received in the first and second surfaces of the middle plate are the same, wherein each of the first and second coupling bolts has a bolt length $H_b$ that is proportional to thicknesses $H_{c1}$ and $H_{c2}$ of the first and second cylinders and a thickness $H_m$ of the middle plate, and wherein the length $H_b$ of each coupling bolt is proportional to the thickness $H_{c1}$ and $H_{c2}$ of the first and second cylinders and the thickness $H_m$ the middle plate in accordance with the formula $$A\frac{H_{c1}+H_{c2}}{H_m} < H_b < B\frac{H_{c1}+H_{c2}}{H_m},$$

where variable A is in the range of 15<A<20, and variable B is in the range of 25<B<30.

13. The rotary compressor of claim 12, wherein a total coupling depth of each of the first and second coupling bolts into the first and second sides of the middle plate is less than a thickness of the middle plate.

14. The rotary compressor of claim 12, wherein the suction passage comprises:

a suction hole formed in the middle in a radial direction so as to communicate with a gas suction pipe; and first and second divergent holes that diverge from an end of the suction hole and respectively extend toward the first and second cylinders so as to respectively communicate with the suction ports of the first and second cylinders, wherein the first and second divergent holes are inclined with respect to a center line of the suction hole.

* * * * *